US011118740B1

(12) United States Patent
Wang et al.

(10) Patent No.: US 11,118,740 B1
(45) Date of Patent: Sep. 14, 2021

(54) LIGHT APPARATUS

(71) Applicant: XIAMEN LEEDARSON LIGHTING CO. LTD, Fujian (CN)

(72) Inventors: Linhua Wang, Fujian (CN); Liangliang Cao, Fujian (CN)

(73) Assignee: XIAMEN LEEDARSON LIGHTING CO. LTD, Xiamen (CN)

( * ) Notice: Subject to any disclaimer, the term of this patent is extended or adjusted under 35 U.S.C. 154(b) by 0 days.

(21) Appl. No.: 16/916,649

(22) Filed: Jun. 30, 2020

(51) Int. Cl.

| | |
|---|---|
| ***F21K 9/272*** | (2016.01) |
| ***F21K 9/69*** | (2016.01) |
| ***F21V 29/71*** | (2015.01) |
| ***F21Y 107/50*** | (2016.01) |
| ***F21Y 115/10*** | (2016.01) |
| ***F21Y 103/10*** | (2016.01) |

(52) U.S. Cl.
CPC ..... *F21K 9/272* (2016.08); *F21K 9/69* (2016.08); *F21V 29/713* (2015.01); *F21Y 2103/10* (2016.08); *F21Y 2107/50* (2016.08); *F21Y 2115/10* (2016.08)

(58) Field of Classification Search
CPC . F21K 9/272; F21K 9/69; F21K 9/235; F21V 29/713; F21V 5/046; F21V 23/005; F21V 29/75; F21S 4/00; F21S 4/20; F21Y 2115/10; F21Y 2107/50; F21Y 2103/10
See application file for complete search history.

(56) References Cited

U.S. PATENT DOCUMENTS

| | | | | |
|---|---|---|---|---|
| 8,338,852 | B2 * | 12/2012 | Hochstein | F21V 29/763 257/99 |
| 8,360,599 | B2 * | 1/2013 | Ivey | F21K 9/69 362/218 |
| 9,035,549 | B2 * | 5/2015 | Kim | G02B 6/0091 313/512 |
| 10,302,292 | B2 * | 5/2019 | May | H01R 33/0845 |
| 2012/0008318 | A1 * | 1/2012 | Ishiwata | H05B 45/22 362/231 |
| 2012/0020089 | A1 * | 1/2012 | Hsieh | F21S 4/20 362/249.06 |
| 2012/0069566 | A1 * | 3/2012 | Huang | F21S 8/03 362/235 |
| 2016/0230941 | A1 * | 8/2016 | Halliwell | F21V 23/001 |
| 2020/0171321 | A1 * | 6/2020 | Bae | A61N 5/0613 |
| 2020/0278089 | A1 * | 9/2020 | Van Eeuwijk | F21K 9/65 |

* cited by examiner

*Primary Examiner* — Peggy A Neils
(74) *Attorney, Agent, or Firm* — Chun-Ming Shih; Lanway IPR Services

(57) ABSTRACT

A lighting apparatus includes a LED strip having an elongated substrate and multiple LED modules. A light passing cover enclosing the LED strip. The light passing cover have an extending linear surface with a main portion and a transition portion. A first cap and a second cap connect to the light passing cover. The first cap has a first connecting surface, a first contacting surface, and a first side surface. The second cap has a second connecting surface, a second contacting surface, and a second side surface. The first connecting surface and the second connecting surface provide a bridge connecting to the light passing cover. The first contacting surface and the second contacting surface have a transmission between an inner area and an external area of the light passing cover. The first side surface and the second side surface support a structure of the light passing cover.

18 Claims, 9 Drawing Sheets

LIGHT APPARATUS

FIELD

The present invention is related to a lighting fixture and more particularly related to a LED lighting apparatus.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

A lighting apparatus includes a LED strip. The LED strip has an elongated substrate and multiple LED modules. The multiple LED modules is divided into at least a first section and a second section. A first heat per area generated by the first section is different from a second heat per area generated by the second section. The first section and the second section are arranged at different positions of the elongated substrate.

A light passing cover encloses the LED strip. The light passing cover has an extending linear surface with a main portion and a transition portion. The main portion has light passing out. The transition portion supports a steady structure of the light passing cover. A first cap and a second cap are connected to the light passing cover respectively on an opposite direction of the light passing cover. The first cap has a first connecting surface, a first contacting surface, and a first side surface. The second cap has a second connecting surface, a second contacting surface, and a second side surface. The first connecting surface and the second connecting surface provide a bridge connecting to the light passing cover. The first contacting surface and the second contacting surface have a transmission between an inner area and an external area of the light passing cover. The first side surface and the second side surface is a supporting structure of the light passing cover. Each section of the lighting apparatus may release different amount of heat.

In some embodiments, there are different amounts of the multiple LED modules per area disposed in the first section and the second section.

In some embodiments, the multiple LED modules in the first section and the multiple LED modules in the second section have different power ratios.

In some embodiments, the first section is at a middle area of the elongated substrate. The second section is at a peripheral end of the elongated substrate. An amount of the multiple LED modules have a higher density in the first section than the second section.

In some embodiments, the first section has a slop bridge. The slop bridge has a higher part and a lower part. The higher part is near the middle area of the elongated substrate. The lower part is near the peripheral end of the elongated substrate. The higher part and the lower part has a lighting angle of the multiple LED modules irradiated from a direction of the first section to the second section.

In some embodiments, the first section has a larger amount of the LED strip than the amount of the second section. For example, the first section is at the middle area of the elongated substrate. The second section is at the peripheral end of the elongated substrate. The first section has a larger amount of the LED strip to provide a stronger luminosity. For another example, the first section is at the peripheral end of the elongated substrate. The second section is at the middle of the elongated substrate. The first section has a larger amount of the LED strip to provide a stronger luminosity.

In some embodiments, the multiple LED modules have a lens structure. The lens structure refracts a light inclined towards the second section. The first section is at a middle area of the elongated substrate. The second section is at a peripheral end of the elongated substrate. The lens structure refracts the light to the second section for providing a luminance to the peripheral end of the light passing cover. The peripheral end of the light passing cover may have less luminance and have dark spots. The lens structure provides a way to have the a same luminance at the middle area and the peripheral part of the light passing cover.

In some embodiments, the first section is at a peripheral end of the elongated substrate. The second section is at a middle area of the elongated substrate. An amount of the LED modules has a lower density in the second section than the first section.

In some embodiments, the first section has a slop bridge. The slop bridge has a higher part and a lower part. The higher part is near the peripheral end of the elongated substrate. The lower part is near the middle area of the elongated substrate. The higher part and the lower part has a lighting angle of the multiple LED modules irradiated from a direction of the first section to the second section.

In some embodiments, the multiple LED modules have a lens structure. The lens structure refracts a light inclined towards the second section. The first section is at a peripheral end of the elongated substrate. The second section is at a middle area of the elongated substrate. The first section may have less amount of the multiple LED modules In some embodiments, multiple heat dissipation belts is for passing a heat individually from each area of the lighting apparatus. The multiple heat dissipation belts have a gap toward each multiple heat dissipation belts.

In some embodiments, the multiple heat dissipation belts each have different widths and different lengths. For example, an element has more heat may connected to a wider heat dissipation belt for increasing the efficiency of the heat dissipation. An element has less heat may connected to a longer and thinner heat dissipation belt for transmitting the heat out of the light passing cover to maintain a same heat dissipation speed of every elements.

In some embodiments, the multiple heat dissipation belts in a middle part of the light passing cover is thicker than the multiple heat dissipation belts in a peripheral end of the light passing cover. The multiple heat dissipation belts in the middle part of the light passing cover is thicker for passing out the heat faster because the middle part of the light passing cover may have more heat in the middle part than the peripheral end of the light passing cover. A thicker heat dissipation belt may pass out the heat faster than a thin heat dissipation belt.

In some embodiments, the multiple heat dissipation belts in a middle part of the light passing cover is thinner than the multiple heat dissipation belts in a peripheral end of the light passing cover. The multiple heat dissipation belts in the middle part of the light passing cover is thinner because the peripheral end of the light passing cover may have more heat than the middle part of the light passing cover. A thicker heat dissipation belt may pass out the heat faster than a thin heat dissipation belt.

In some embodiments, the multiple heat dissipation belts have an ambient edge with a plurality of protruding portions. The plurality of protruding portions is connected on an uneven wave surface for increasing the efficiency of the heat dissipation.

In some embodiments, the multiple heat dissipation belts have an end section connected to a heat sink. For example, the end section is connected to a heat sink to increase a surface of heat dissipation for the heat to pass out faster.

In some embodiments, the multiple heat dissipation belts are connected to multiple isolated heat sinks. Each of the multiple heat dissipation belts are related to the multiple isolated heat sinks correspondingly.

In some embodiments, the heat sink is divided into several sections for passing the heat out from each area of the lighting apparatus separately. For example, each area of the lighting apparatus may have a corresponding heat sink area to pass the heat. The heat of a first area and the heat of the second area may have a first area heat sink and a second area heat sink for passing out each of the heat separately.

In some embodiments, the multiple heat dissipation belts have a gaping distance surrounding at a peripheral edge of each the multiple heat dissipation belts. The multiple heat dissipation belts are separated from inputting power. For example, the multiple heat dissipation belts are connected to the multiple LED modules for passing out the heat and another wire conducts power to the multiple LED modules separated from the multiple heat dissipation belts. A heat belt and another heat belt have a distance between each other to prevent the heat gathered to decrease the efficiency of the heat dissipation.

In some embodiments, the multiple LED modules have at least a first color temperature and a second color temperature. The first color temperature of the multiple LED modules and the second temperature of the multiple LED modules are arranged unequally. The arrangement of the first color temperature and the second color temperature of the multiple LED modules may be crossed and cruciate for providing an even color of light passing out the light passing cover. The arrangement of the first color temperature and the second color temperature of the multiple LED modules may be unregular. The first color temperature of the multiple LED modules as a X and the second color temperature of the multiple LED modules as a Y. The arrangement may be XXXYY, XYXYY, YXXXX, XYYYX or XXYYX . . . etc. The multiple LED modules may output different quantity of light based on an expectation of a user. For example, the first color temperature of the multiple LED modules may output sixty percent of light and the second color temperature of the multiple LED modules may output forty percent of light to provide a kind of light color passing out the light passing cover. The first color temperature of the multiple LED modules may output twenty percent of light and the second color temperature of the multiple LED modules may output eighty percent of light to provide a kind of light color passing out the light passing cover. The user may set up a needed or wanted light color through controlling the light color and the luminosity of the light by an external controller, an app or a switch . . . etc.

DETAILED DESCRIPTION

Figure 1:
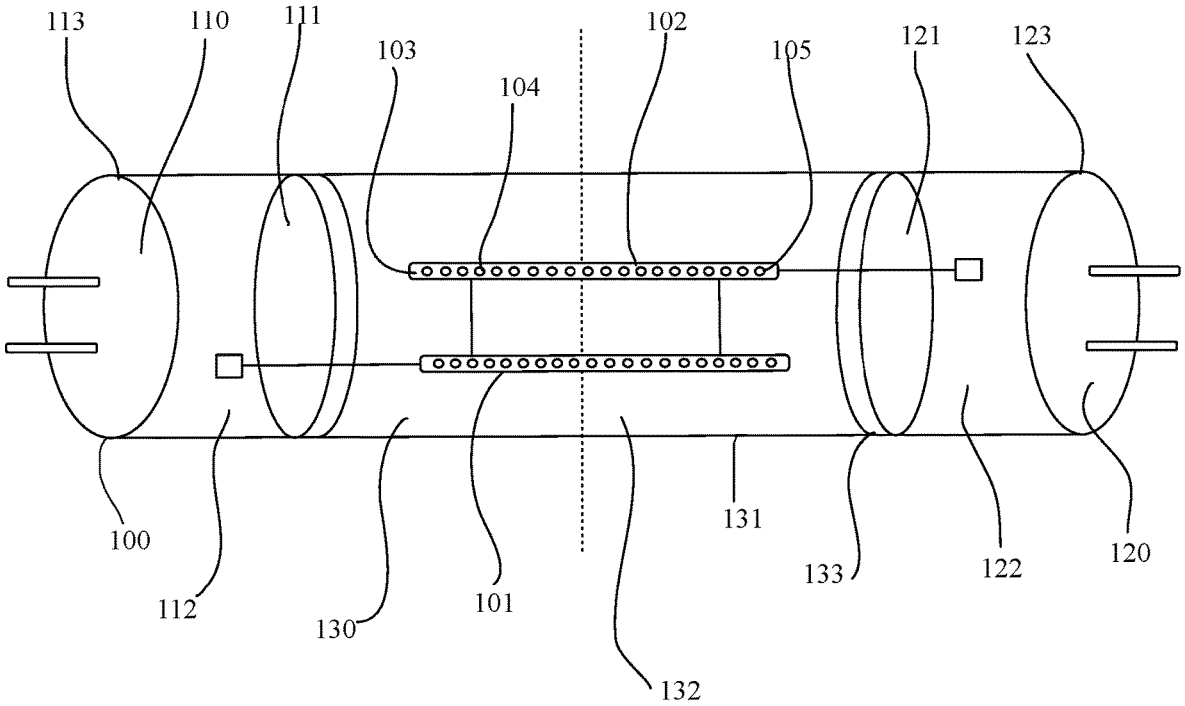
FIG. 1 is a perspective side view of a lighting apparatus according to an embodiment of the present disclosure.

In the drawings, like reference characters generally refer to the same parts throughout the different views. The drawings are not necessarily to scale, emphasis instead generally being placed upon illustrating the principles of the disclosed embodiments. In the following description, various embodiments are described with reference to the following drawings.

Referring to FIG. 1, a lighting apparatus 100 includes a LED strip 102. The LED strip 102 has an elongated substrate 103 and multiple LED modules 104. The multiple LED modules 104 is divided into at least a first section 101 and a second section 105. A first heat per area generated by the first section 101 is different from a second heat per area generated by the second section 105. The first section 101 and the second section 105 are arranged at different positions of the elongated substrate 103.

A light passing cover 130 encloses the LED strip 102. The light passing cover 130 has an extending linear surface 131 with a main portion 132 and a transition portion 133. The main portion 132 has light passing out. The transition portion 133 supports a steady structure of the light passing cover 130. A first cap 113 and a second cap 123 are connected to the light passing cover 130 respectively on an opposite direction of the light passing cover 130. The first cap 113 has a first connecting surface 111, a first contacting surface 110, and a first side surface 112. The second cap 123 has a second connecting surface 121, a second contacting surface 120, and a second side surface 122. The first connecting surface 111 and the second connecting surface 121 provide a bridge connecting to the light passing cover 130. The first contacting surface 110 and the second contacting surface 120 have a transmission between an inner area and an external area of the light passing cover. The first side surface 112 and the second side surface 122 are a supporting structure of the light passing cover 130. Each section of the lighting apparatus 100 may release different amount of heat.

In some embodiments, there are different amounts of the multiple LED modules 104 per area disposed in the first section 101 and the second section 105.

In some embodiments, the multiple LED modules 104 in the first section 101 and the multiple LED modules 104 in the second section 105 have different power ratios.

Figure 2:
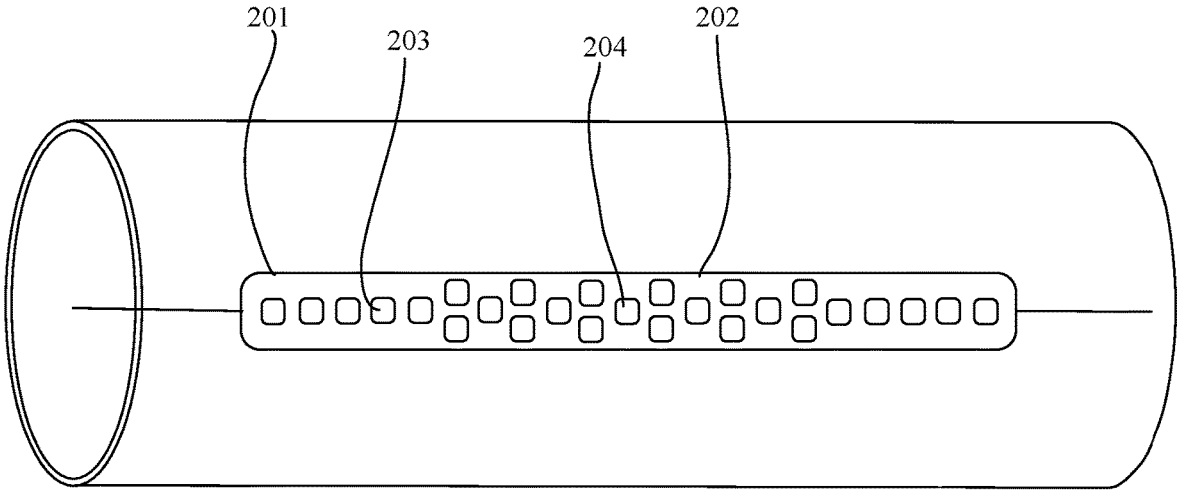
FIG. 2 is a perspective side view of a lighting apparatus according to an embodiment of the present disclosure.

Referring to FIG. 1 and FIG. 2, the first section 101 is at a middle area 202 of the elongated substrate 103. The second section 105 is at a peripheral end 201 of the elongated substrate 103. An amount of the multiple LED modules 104 have a higher density in the first section 101 than the second section 105.

Figure 3:
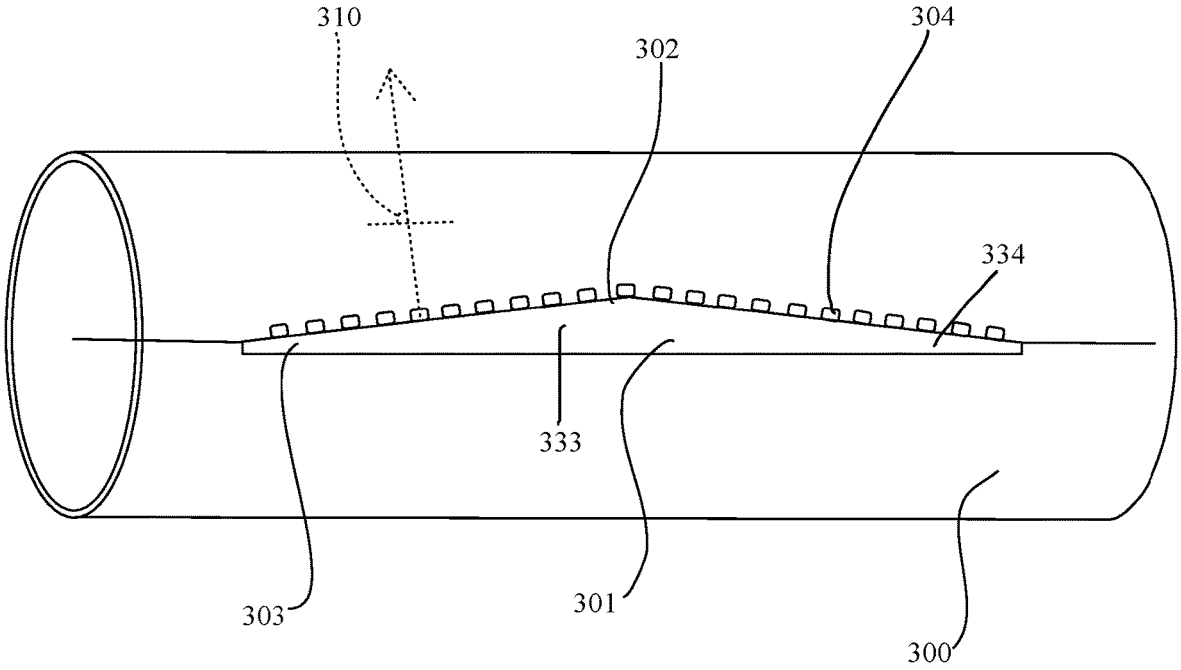
FIG. 3 is a perspective side view of a lighting apparatus according to an embodiment of the present disclosure.

Referring to FIG. 3, the lighting apparatus 300 has the first section 333 and the second section 334. The first section 333 has a slop bridge 301. The slop bridge 301 has a higher part 302 and a lower part 303. The higher part 302 is near the middle area of the elongated substrate. The lower part 303 is near the peripheral end of the elongated substrate. The higher part 302 and the lower part 303 has a lighting angle 310 of the multiple LED modules 304 irradiated from a direction of the first section 333 to the second section 334.

In some embodiments, the first section 333 has a larger amount of the LED strip than the amount of the second section 334. For example, the first section 333 is at the middle area of the elongated substrate. The second section 334 is at the peripheral end of the elongated substrate. The first section 333 has a larger amount of the LED strip to provide a stronger luminosity. For another example, the first section 333 is at the peripheral end of the elongated substrate. The second section 334 is at the middle of the elongated substrate. The first section 333 has a larger amount of the LED strip to provide a stronger luminosity.

Figure 4:
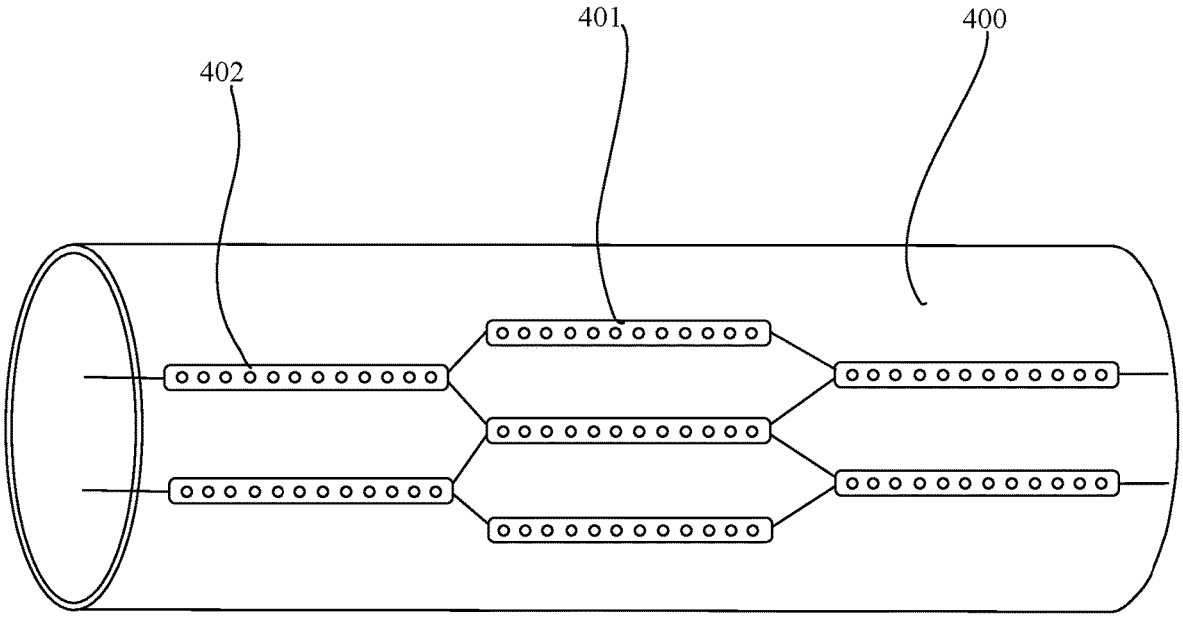
FIG. 4 is a perspective side view of a lighting apparatus according to an embodiment of the present disclosure.

In FIG. 4, a light tube includes a left section, a middle section and a right section. In the left section, two LED strip segments 402 are disposed. In the middle section, three LED strip segments 401 are disposed. In the right section, two LED strip segments 400 are disposed. Specifically, the LED segments as well LED modules have different intensities in different sections of a light tube. Such arrangement makes a visual effect different from traditional light tubes. In addition, the LED strip segments may be arranged with different directions for adjusting their light output directions.

Figure 5:
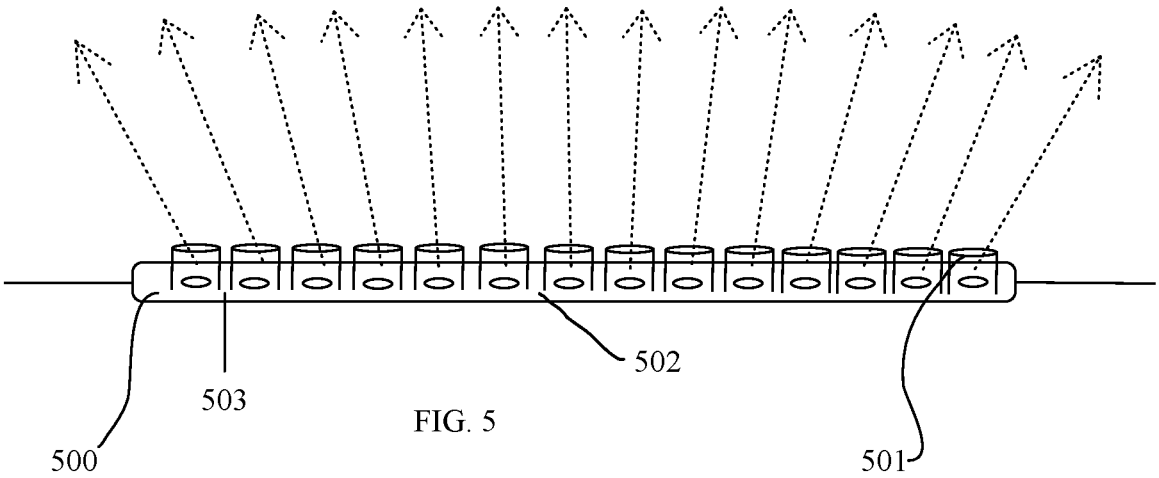
FIG. 5 is a schematic side view of a lens structure according to an embodiment of the present disclosure.

Referring to FIG. 5, the multiple LED modules have a lens structure 501. The lens structure 501 refracts a light inclined towards the second section 503. The first section 502 is at a middle area of the elongated substrate. The second section 503 is at a peripheral end of the elongated substrate. The lens structure 501 refracts the light to the second section 503 for providing a luminance to the peripheral end of the light passing cover. The peripheral end of the light passing cover may have less luminance and have dark spots. The lens structure 501 provides a way to have the a same luminance at the middle area and the peripheral end of the light passing cover.

Figure 7:
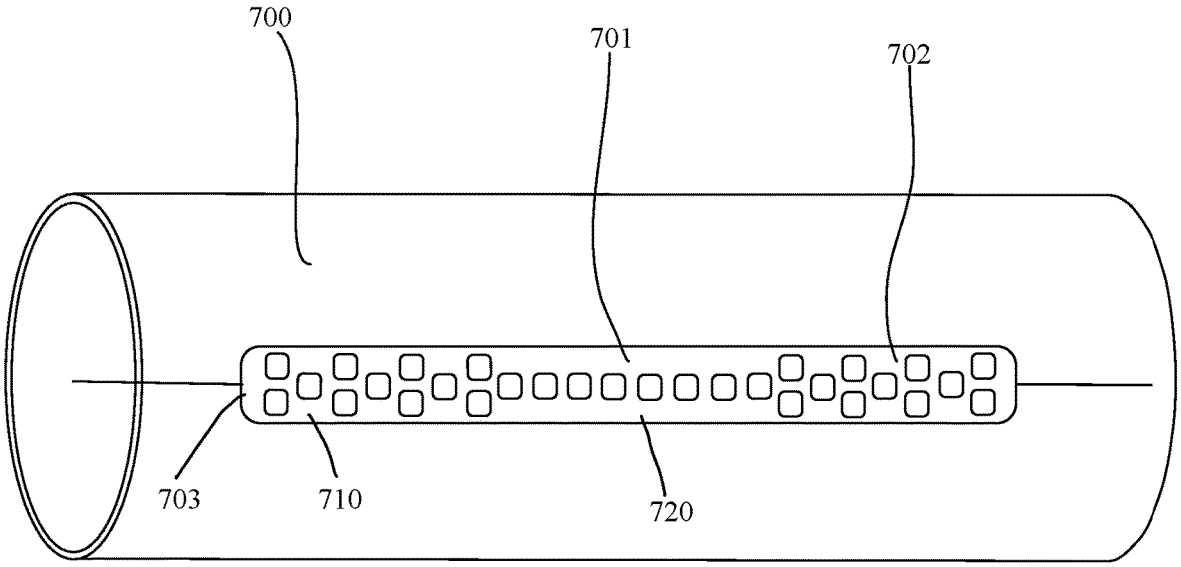
FIG. 7 is a perspective side view of a lighting apparatus according to an embodiment of the present disclosure.

Referring to FIG. 7, the first section 702 is at a peripheral end 710 of the elongated substrate 703. The second section 701 is at a middle area 720 of the elongated substrate 703. An amount of the LED modules has a lower density in the second section 701 than the first section 702.

Figure 8:
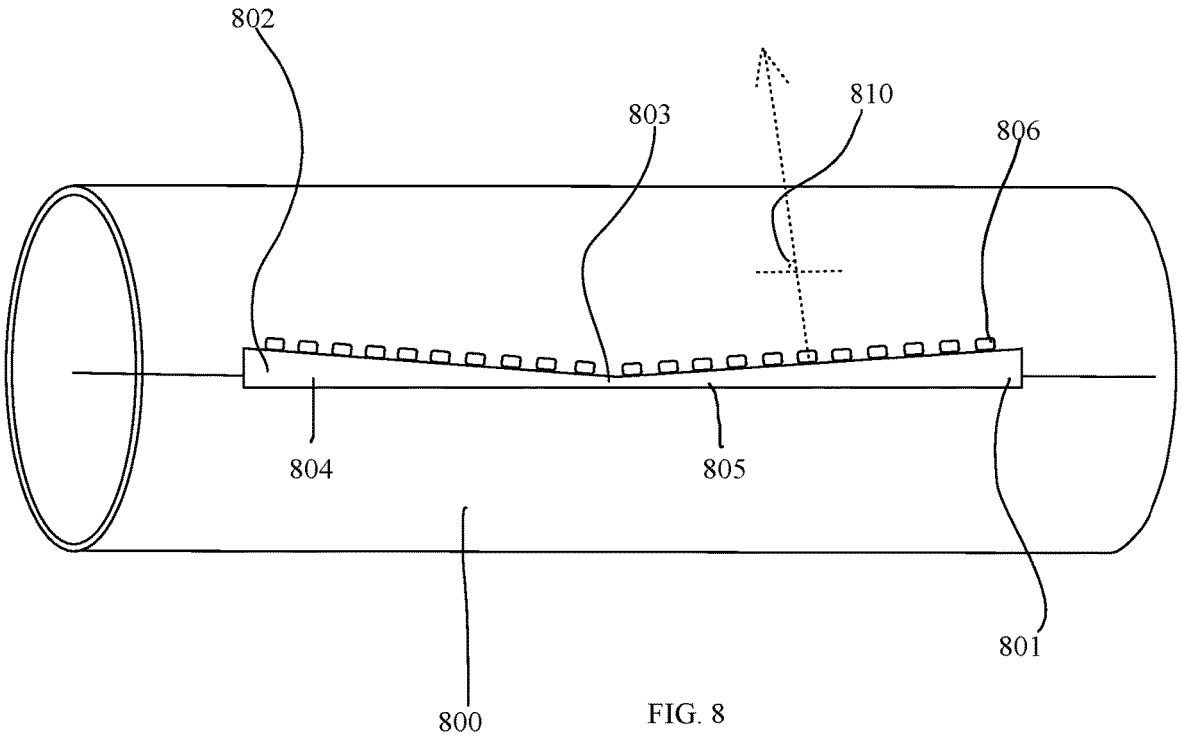
FIG. 8 is a perspective side view of a lighting apparatus according to an embodiment of the present disclosure.

Referring to FIG. 8, the lighting apparatus 800 has the first section 804 and the second section 805. The first section 804 has a slop bridge 801. The slop bridge 801 has a higher part 802 and a lower part 803. The higher part 802 is near the peripheral end of the elongated substrate. The lower part 803 is near the middle area of the elongated substrate. The higher part 802 and the lower part 803 has a lighting angle 810 of the multiple LED modules 806 irradiated from a direction of the first section 804 to the second section 805.

Figure 6:
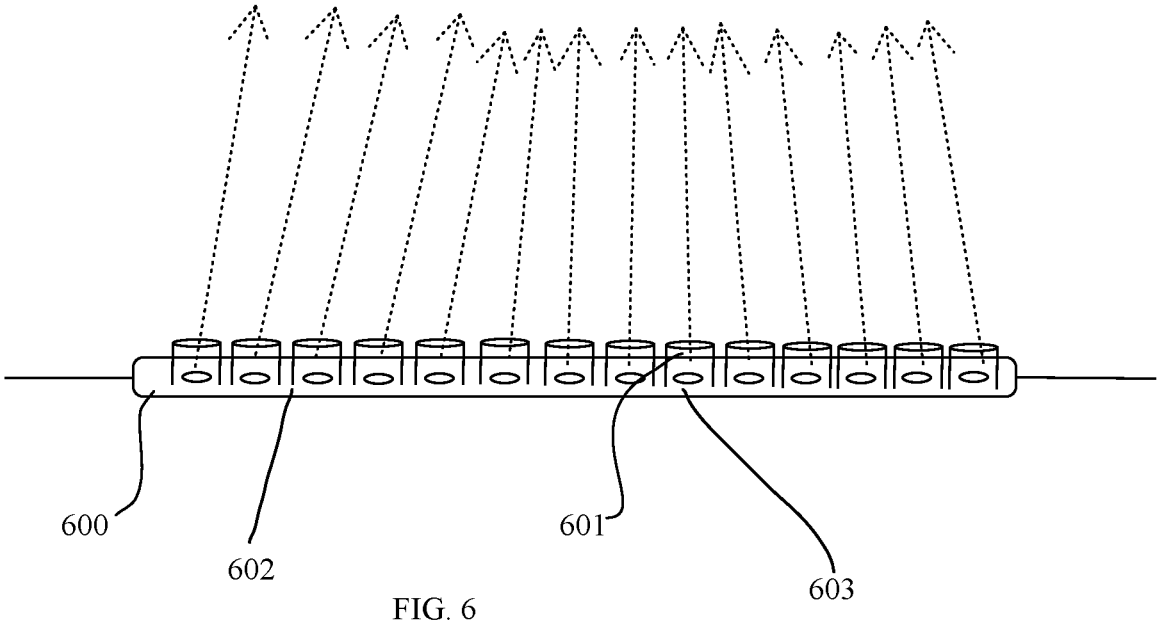
FIG. 6 is a schematic side view of a lens structure according to an embodiment of the present disclosure.

Referring to FIG. 6, the multiple LED modules have a lens structure 601. The lens structure 601 refracts a light inclined towards the second section 603. The first section 602 is at a peripheral end of the elongated substrate. The second section 603 is at a middle area of the elongated substrate. The first section 602 may have less amount of the multiple LED modules than the second section 603.

Figure 9A:
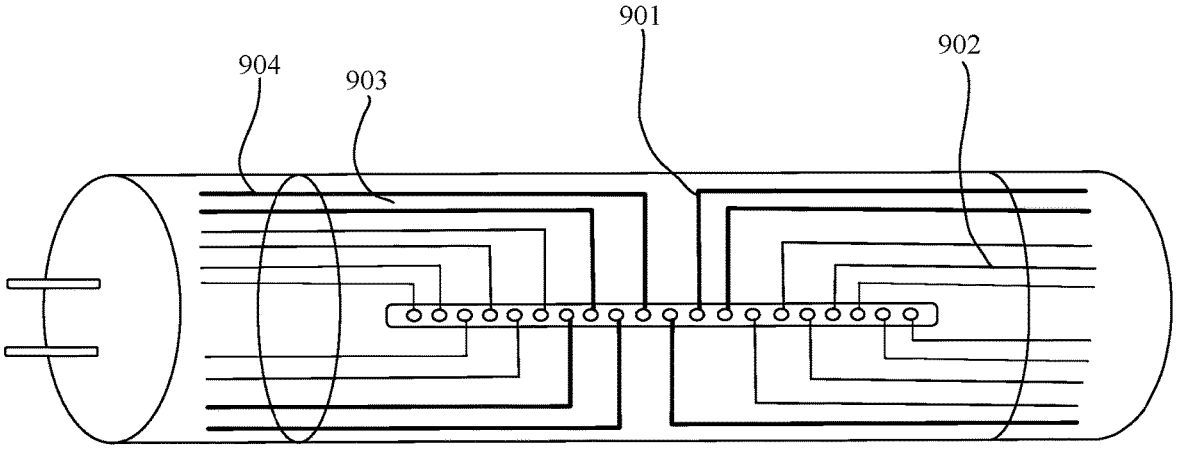
FIG. 9A is a perspective side view of multiple heat dissipation belts according to an embodiment of the present disclosure.
Figure 9B:
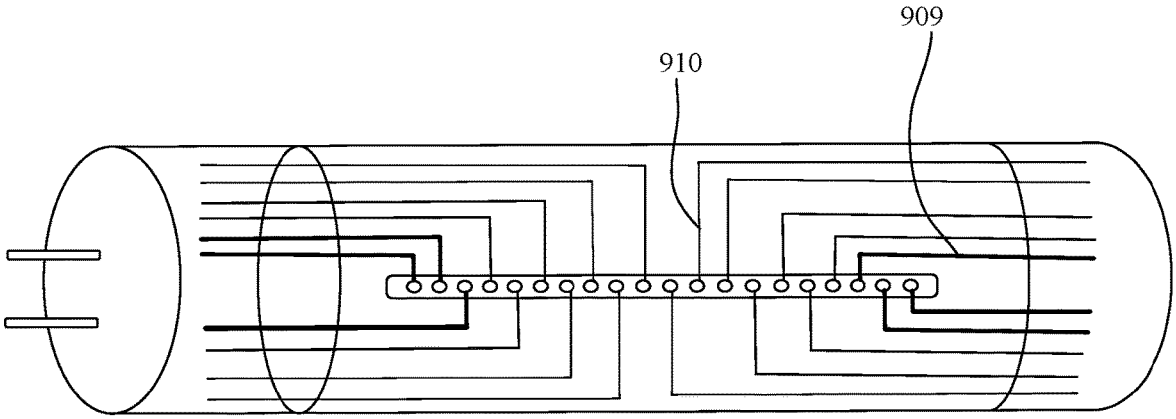
FIG. 9B is a perspective side view of multiple heat dissipation belts according to an embodiment of the present disclosure.

Referring to FIGS. 9A and 9B, multiple heat dissipation belts 901 is for passing a heat individually from each area of the lighting apparatus. The multiple heat dissipation belts 901 have a gap 903 toward each multiple heat dissipation belts 901.

In some embodiments, the multiple heat dissipation belts 901 each have different widths and different lengths. For example, an element has more heat may connected to a wider heat dissipation belt 901 for increasing the efficiency of the heat dissipation. An element has less heat may connected to a longer and thinner heat dissipation belt for transmitting the heat out of the light passing cover to maintain a same heat dissipation speed of every elements.

In some embodiments, the multiple heat dissipation belts 901 in a middle part of the light passing cover is thicker than the multiple heat dissipation belts 902 in a peripheral end of the light passing cover. The multiple heat dissipation belts 901 in the middle part of the light passing cover is thicker for passing out the heat faster because the middle part of the light passing cover may have more heat in the middle part than the peripheral end of the light passing cover. A thicker heat dissipation belt may pass out the heat faster than a thin heat dissipation belt.

In some embodiments, the multiple heat dissipation belts 910 in a middle part of the light passing cover is thinner than the multiple heat dissipation belts 909 in a peripheral end of the light passing cover. The multiple heat dissipation belts 910 in the middle part of the light passing cover is thinner because the peripheral end of the light passing cover may have more heat than the middle part of the light passing cover. A thicker heat dissipation belt may pass out the heat faster than a thin heat dissipation belt.

Figure 10:
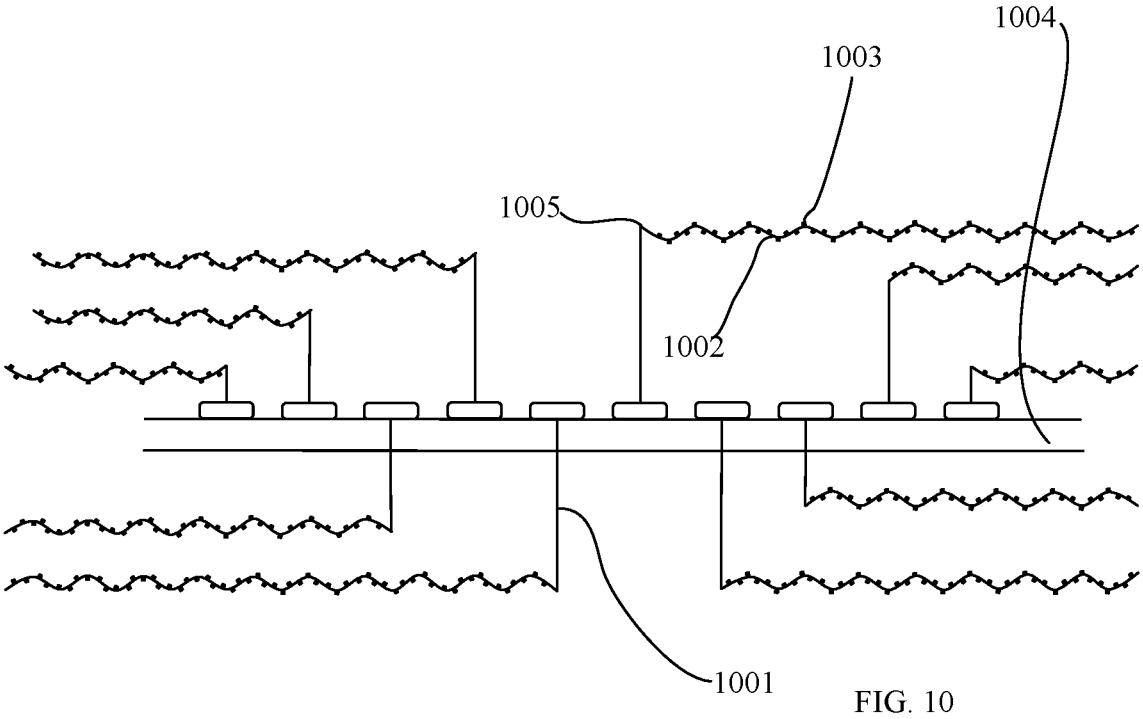
FIG. 10 is a schematic side view of multiple heat dissipation belts according to an embodiment of the present disclosure.

Referring to FIG. 10, the LED strip 1004 has the multiple heat dissipation belts 1001. The multiple heat dissipation belts 1001 have an ambient edge 1002 with a plurality of protruding portions 1003. The plurality of protruding portions 1003 is connected on an uneven wave surface 1005 for increasing the efficiency of the heat dissipation.

Figure 11:
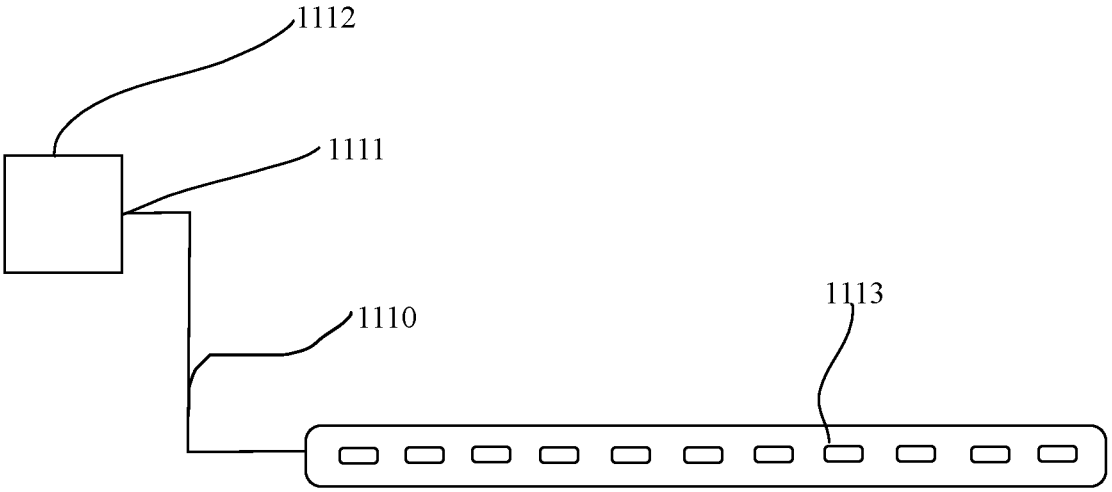
FIG. 11 is a schematic side view of a heat sink according to an embodiment of the present disclosure.

Referring to FIG. 11, the multiple heat dissipation belts 1110 have an end section 1111 connected to a heat sink 1112. For example, the end section 1111 is connected to the heat sink 1112 to increase a surface of heat dissipation for the heat to pass out faster.

Figure 12:
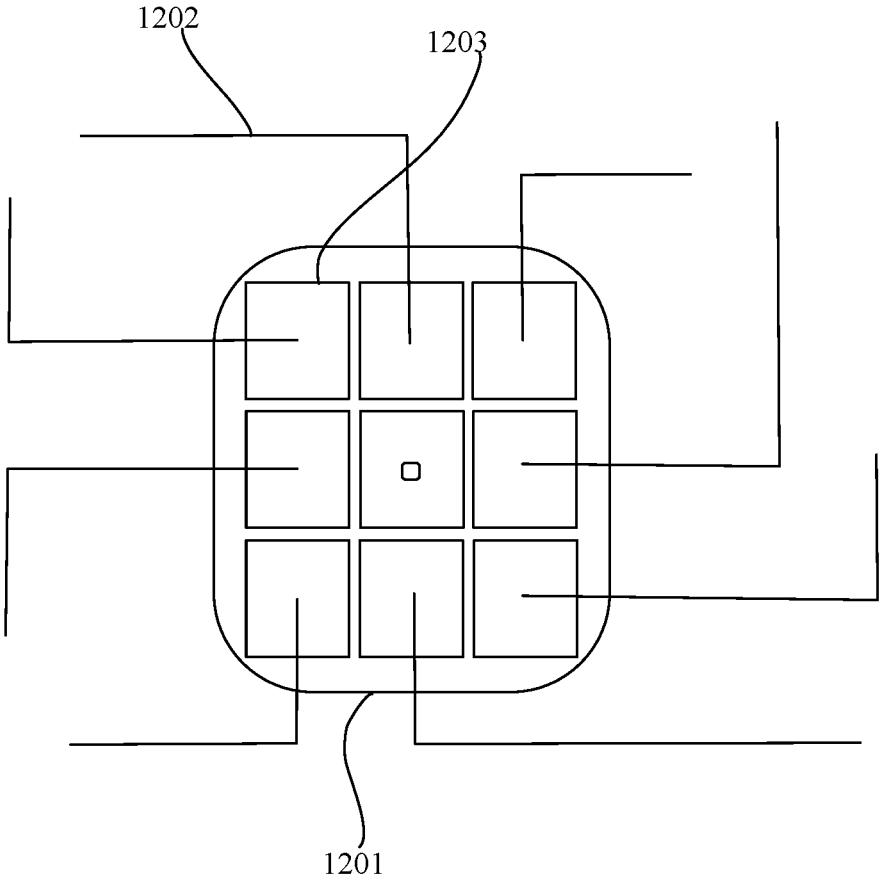
FIG. 12 is a schematic side view of a heat sink according to an embodiment of the present disclosure.

Referring to FIG. 12, the multiple heat dissipation belts 1202 are connected to multiple isolated heat sinks 1203. Each of the multiple heat dissipation belts 1202 are related to the multiple isolated heat sinks 1203 correspondingly.

In some embodiments, the heat sink 1201 is divided into several sections for passing the heat out from each area of the lighting apparatus separately. For example, each area of the lighting apparatus may have a corresponding heat sink area to pass the heat. The heat of a first area and the heat of the second area may have a first area heat sink and a second area heat sink for passing out each of the heat separately.

Figure 13:
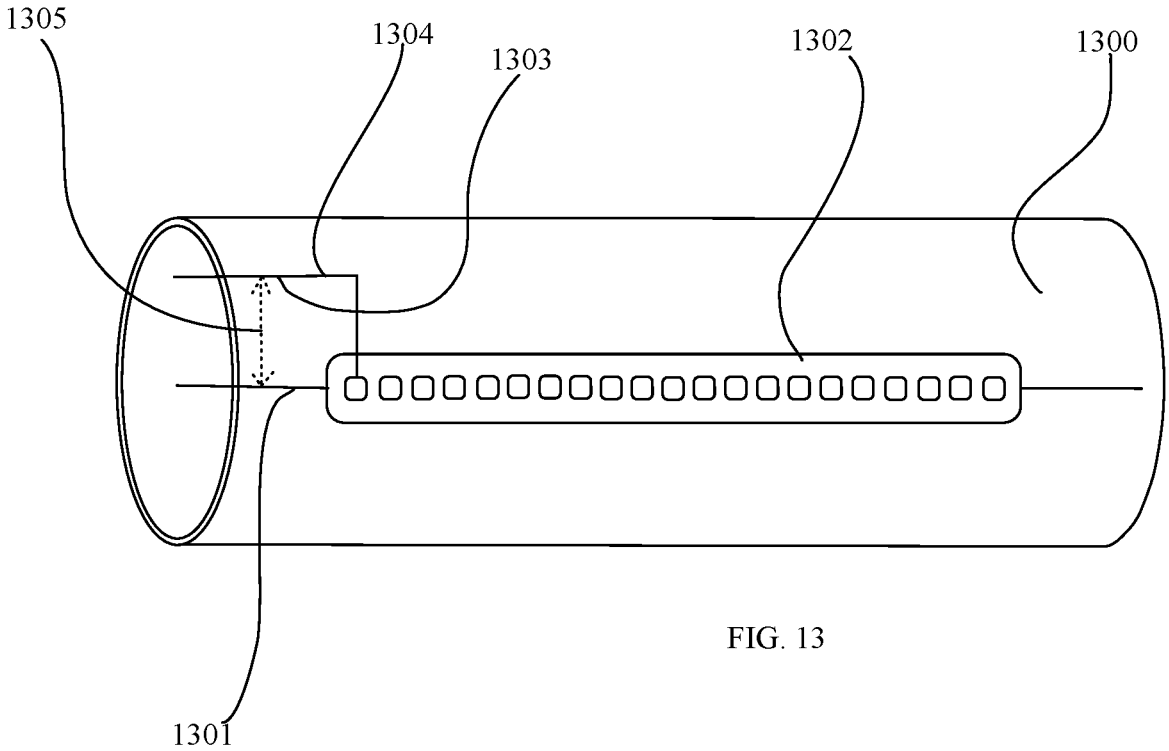
FIG. 13 is a perspective side view of a lighting apparatus according to an embodiment of the present disclosure.

Referring to FIG. 13, inside the light passing cover 1300, the multiple heat dissipation belts 1304 have a gaping distance 1305 surrounding at a peripheral edge 1303 of each the multiple heat dissipation belts 1304. The multiple heat dissipation belts 1304 are separated from inputting a power 1301 to the multiple LED modules 1302 for emitting light. For example, the multiple heat dissipation belts 1304 are connected to the multiple LED modules 1302 for passing out the heat and another wire conducts the power to the multiple LED modules 1302 separated from the multiple heat dissipation belts 1304. A heat belt and another heat belt have a distance between each other to prevent the heat gathered to decrease the efficiency of the heat dissipation.

Figure 14:
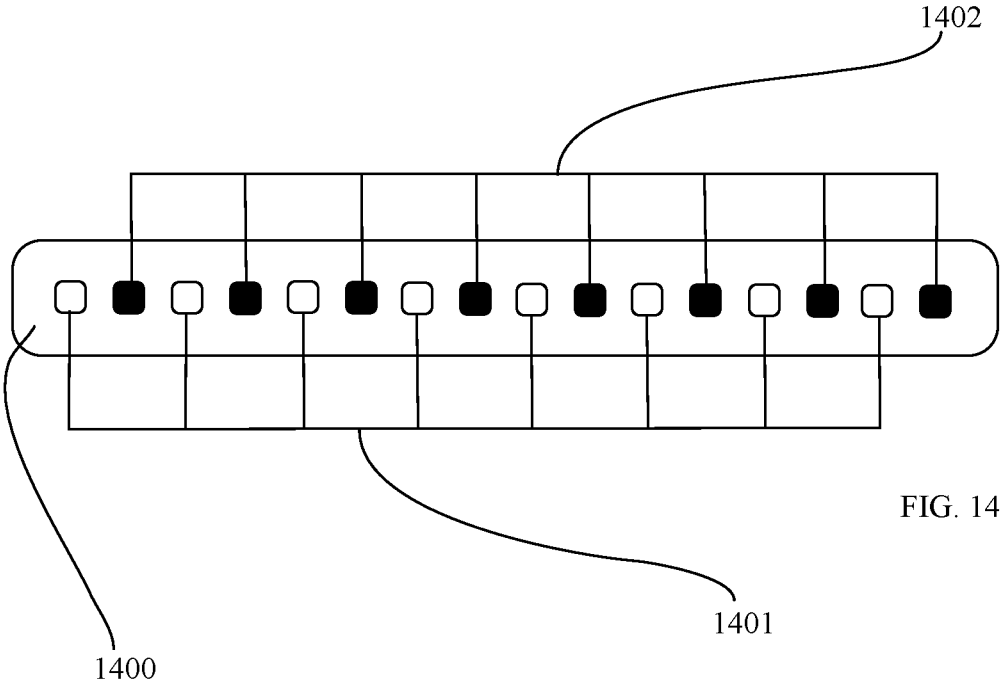
FIG. 14 is a schematic view of a first color temperature and a second color temperature according to an embodiment of the present disclosure.

Referring to FIG. 14, the multiple LED modules 1400 have at least a first color temperature 1401 and a second color temperature 1402. The first color temperature 1401 of the multiple LED modules 1400 and the second temperature 1402 of the multiple LED modules 1400 are arranged unequally. The arrangement of the first color temperature 1401 and the second color temperature 1402 of the multiple LED modules 1400 may be crossed and cruciate for providing an even color of light passing out the light passing cover. The arrangement of the first color temperature 1401 and the second color temperature 1402 of the multiple LED modules 1400 may be unregular. The first color temperature 1401 of the multiple LED modules 1400 as a X and the second color temperature 1402 of the multiple LED modules 1400 as a Y. The arrangement may be XXXYY, XYXYY, YXXXX, XYYYX or XXYYX . . . etc. The multiple LED modules 1400 may output different quantity of light based on an expectation of a user. For example, the first color temperature 1401 of the multiple LED modules 1400 may output sixty percent of light and the second color temperature 1402 of the multiple LED modules 1400 may output forty percent of light to provide a kind of light color passing out the light passing cover. The first color temperature 1401 of the multiple LED modules 1400 may output twenty percent of light and the second color temperature 1402 of the multiple LED modules 1400 may output eighty percent of light to provide a kind of light color passing out the light passing cover. The user may set up a needed or wanted light color through controlling the light color and the luminosity of the light by an external controller, an app or a switch . . . etc.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a LED strip having an elongated substrate and multiple LED modules, the multiple LED modules being divided into at least a first section and a second section, a first heat per area generated by the first section is different from a second heat per area generated by the second section, the first section and the second section being arranged at different positions of the elongated substrate;

a light passing cover enclosing the LED strip, the light passing cover having an extending linear surface with a main portion and a transition portion, the main portion having light passing out, the transition portion supporting a steady structure of the light passing cover; and a first cap and a second cap connecting to the light passing cover respectively on an opposite direction of the light passing cover, the first cap having a first connecting surface, a first contacting surface, and a first side surface, the second cap having a second connecting surface, a second contacting surface, and a second side surface, the first connecting surface and the second connecting surface providing a bridge connecting to the light passing cover, the first contacting surface and the second contacting surface having a transmission between an inner area and an external area of the light passing cover, the first side surface and the second side surface being a supporting structure of the light passing cover, wherein the first section is at a peripheral end of the elongated substrate, the second section is at a middle area of the elongated substrate, an amount of the LED modules has a lower density in the second section than the first section, wherein the multiple LED modules have a lens structure, the lens structure refracts a light inclined towards the second section.

2. The lighting apparatus of claim 1, wherein there are different amounts of the multiple LED modules per area disposed in the first section and the second section.

3. The lighting apparatus of claim 1, wherein the multiple LED modules in the first section and the LED modules in the second section have different power ratios.

4. The lighting apparatus of claim 1, wherein the first section is at a middle area of the elongated substrate, the second section is at a peripheral end of the elongated substrate, an amount of the multiple LED modules have a higher density in the first section than the second section.

5. The lighting apparatus of claim 4, wherein the first section has a slop bridge, the slop bridge has a higher part and a lower part, the higher part is near the middle area of the elongated substrate, the lower part is near the peripheral end of the elongated substrate, the higher part and the lower part has a lighting angle of the multiple LED modules irradiated from a direction of the first section to the second section.

6. The lighting apparatus of claim 5, wherein the first section has a larger amount of the LED strip than the amount of the second section.

7. The lighting apparatus of claim 4, wherein the multiple LED modules have a lens structure, the lens structure refracts a light inclined towards the second section.

8. The lighting apparatus of claim 1, wherein the first section has a slop bridge, the slop bridge has a higher part and a lower part, the higher part is near the peripheral end of the elongated substrate, the lower part is near the middle area of the elongated substrate, the higher part and the lower part has a lighting angle of the multiple LED modules irradiated from a direction of the first section to the second section.

9. The lighting apparatus of claim 1, further comprising multiple heat dissipation belts for passing a heat individually from each area of the lighting apparatus, the multiple heat dissipation belts having a gap toward each multiple heat dissipation belts.

10. The lighting apparatus of claim 9, wherein the multiple heat dissipation belts each have different widths and different lengths.

11. The lighting apparatus of claim 10, wherein the multiple heat dissipation belts in a middle part of the light passing cover is thicker than the multiple heat dissipation belts in a peripheral end of the light passing cover.

12. The lighting apparatus of claim 10, wherein the multiple heat dissipation belts in a middle part of the light passing cover is thinner than the multiple heat dissipation belts in a peripheral end of the light passing cover.

13. The lighting apparatus of claim 9, wherein the multiple heat dissipation belts have an ambient edge with a plurality of protruding portions, the plurality of protruding portions is connected on an uneven wave surface.

14. The lighting apparatus of claim 9, wherein the multiple heat dissipation belts has an end section connected to a heat sink.

15. The lighting apparatus of claim 14, wherein the multiple heat dissipation belts are connected to multiple isolated heat sinks, each of the multiple heat dissipation belts are related to the multiple isolated heat sinks correspondingly.

16. The lighting apparatus of claim 14, wherein the heat sink is divided into several sections for passing the heat out from each area of the lighting apparatus separately.

17. The lighting apparatus of claim 9, wherein the multiple heat dissipation belts have a gaping distance surrounding at a peripheral edge of each the multiple heat dissipation belts, the multiple heat dissipation belts are separated from inputting a power to the multiple LED modules for emitting light.

18. The lighting apparatus of claim 1, further comprising the multiple LED modules having at least a first color temperature and a second color temperature, the first color temperature of the multiple LED modules and the second temperature of the multiple LED modules being arranged unequally.

* * * * *